US006389330B1

(12) United States Patent
Khesin

(10) Patent No.: US 6,389,330 B1
(45) Date of Patent: May 14, 2002

(54) COMBUSTION DIAGNOSTICS METHOD AND SYSTEM

(75) Inventor: Mark J. Khesin, North Andover, MA (US)

(73) Assignee: Reuter-Stokes, Inc., Twinsburg, OH (US)

( * ) Notice: Subject to any disclaimer, the term of this patent is extended or adjusted under 35 U.S.C. 154(b) by 0 days.

(21) Appl. No.: 09/097,959

(22) Filed: Jun. 16, 1998

Related U.S. Application Data

(60) Provisional application No. 60/069,989, filed on Dec. 18, 1997.

(51) Int. Cl.[7] ..... F23N 5/08; F23N 5/02; F23N 5/00; G08B 17/12; G01K 1/08

(52) U.S. Cl. ..... 700/274; 700/266; 431/14; 431/18; 431/75; 431/76; 431/79

(58) Field of Search ..... 700/274, 266; 431/14, 79, 12, 75, 76, 18; 250/554, 339.15; 374/142; 324/671

(56) References Cited

U.S. PATENT DOCUMENTS

| | | | | |
|---|---|---|---|---|
| 3,689,773 | A | 9/1972 | Wheeler | 250/554 |
| 3,852,729 | A | 12/1974 | Cade | 137/65 |
| 3,903,418 | A | 9/1975 | Horn | 250/338.1 |
| 3,936,648 | A | 2/1976 | Cormault et al. | 250/554 |
| 4,039,844 | A | 8/1977 | MacDonald | 250/554 |
| 4,253,404 | A | 3/1981 | Leonard | 110/188 |
| 4,260,363 | A | 4/1981 | Cratin, Jr. | 431/76 |
| 4,296,727 | A | 10/1981 | Bryan | 126/116 |
| 4,370,557 | A | 1/1983 | Axmark et al. | 250/554 |
| 4,435,149 | A | 3/1984 | Astheimer | 431/12 |
| 4,477,245 | A | 10/1984 | Giachino et al. | 431/78 |
| 4,562,529 | A | 12/1985 | Drummond | 364/140 |
| 4,639,717 | A | 1/1987 | De Meirsman | 340/578 |

(List continued on next page.)

FOREIGN PATENT DOCUMENTS

| | | | |
|---|---|---|---|
| DE | WO 90/09552 | 8/1990 | F23F/5/08 |
| EP | 0 476 601 A | 3/1992 | F23N/5/08 |
| EP | 0 581 451 A | 2/1994 | F23N/5/08 |
| EP | 0766080 A1 | 4/1997 | G01N/21/39 |
| JP | 63169422 A | 7/1988 | F23N/5/02 |
| JP | 200018545 A | 1/2000 | F23G/5/50 |
| JP | 200088232 A | 3/2000 | F23J/1/00 |
| WO | PCT WO 97/24560 | 7/1997 | F23N/5/08 |

OTHER PUBLICATIONS

Sayre et al. "Scaling Characteristics of the Aerodynamics and Low NOx Properties of Industrial Natural Gas Burners. Scaling 400 Study—Part IV: The 300 kW BERL Test Results", Nov. 1994, GRI–94/0186.

Sivanthanu et al. "Miniature Infrared Emission Based Temperature Sensor and Light–Off Detector", Oct. 1997, Conf. Proceedings, Advanced Turbine Systems Annual Program Review Meeting, Poster 5.

Savtavicca et al. "Miniature Infrared Emission Based Temperature Sensor and Light–Off Detector", Oct. 1997, Conf. Proceedings, Advanced Turbine Systems Annual Program Review Meeting, Poster 7.

(List continued on next page.)

*Primary Examiner*—Thomas Lee
*Assistant Examiner*—Katharina Schuster
(74) *Attorney, Agent, or Firm*—Wolf, Greenfield & Sacks, P.C.

(57) ABSTRACT

Combustion variables are diagnosed using sensors to measure turbulence in the post-flame zone as well as in the flame envelope of a combustor. Output signals from the sensors are processed and a set of statistical functions are calculated which are correlated with specific combustion variables, such as the concentration of unburned carbon in fly ash. A special sensor mounting box provides reliable long-term operation in harsh combustor environment, without a supply of cooling or protective air flow.

46 Claims, 8 Drawing Sheets

U.S. PATENT DOCUMENTS

| | | | | |
|---|---|---|---|---|
| 4,691,196 | A | 9/1987 | Kern et al. | 340/578 |
| 4,709,155 | A | 11/1987 | Yamaguchi et al. | 250/554 |
| 4,780,832 | A | 10/1988 | Shah | 702/130 |
| 4,866,420 | A | 9/1989 | Meyer, Jr. | 340/578 |
| 4,885,573 | A | 12/1989 | Fry et al. | 340/519 |
| 4,901,247 | A | 2/1990 | Wakimoto et al. | 364/513 |
| 4,913,647 | A | 4/1990 | Bonne et al. | 431/12 |
| 4,923,117 | A | 5/1990 | Adams et al. | 236/94 |
| 4,927,350 | A | 5/1990 | Zabielski | 431/12 |
| 4,977,376 | A | 12/1990 | Schiek et al. | 324/613 |
| 4,987,772 | A | 1/1991 | Lacey et al. | 73/117.3 |
| 5,037,291 | A | 8/1991 | Clark | 431/12 |
| 5,073,769 | A | 12/1991 | Kompelien | 340/578 |
| 5,076,780 | A | 12/1991 | Erdman | 431/24 |
| 5,077,550 | A | 12/1991 | Cormier | 340/578 |
| 5,107,128 | A | 4/1992 | Davall et al. | 250/554 |
| 5,112,217 | A | 5/1992 | Ripka et al. | 431/12 |
| 5,175,505 | A | 12/1992 | Magenau et al. | 324/671 |
| 5,191,220 | A | 3/1993 | Innes | 250/554 |
| 5,245,196 | A | 9/1993 | Cabalfin | 250/554 |
| 5,246,868 | A | 9/1993 | Busch et al. | 436/101 |
| 5,249,954 | A | 10/1993 | Allen et al. | 431/14 |
| 5,257,496 | A | 11/1993 | Brown et al. | 60/396 |
| 5,280,756 | A | 1/1994 | Labbe | 110/191 |
| 5,332,386 | A | 7/1994 | Hosome et al. | 431/12 |
| 5,496,450 | A | 3/1996 | Blumenthal et al. | 205/782 |
| 5,501,159 | A | 3/1996 | Stevers et al. | 110/188 |
| 5,547,369 | A | 8/1996 | Sohma et al. | 431/75 |
| 5,599,179 | A | 2/1997 | Lindner et al. | 431/12 |
| 5,632,614 | A | 5/1997 | Consadori et al. | 431/79 |
| 5,785,512 | A | 7/1998 | Cormier | 431/79 |
| 5,796,342 | A | 8/1998 | Panov | 340/577 |
| 5,797,736 | A | 8/1998 | Menguc et al. | 431/75 |
| 5,798,946 | A | 8/1998 | Khesin | 364/551.01 |
| 5,813,767 | A | 9/1998 | Calabro' et al. | 374/142 |
| 5,961,314 | A | 10/1999 | Myhre et al. | 431/79 |
| 5,993,194 | A | * 11/1999 | Lemelson et al. | 431/14 |
| 6,071,114 | A | * 6/2000 | Cusack et al. | 431/79 |
| 6,150,659 | A | * 11/2000 | Baliga et al. | 250/339.15 |

OTHER PUBLICATIONS

Savtavicca "Miniature Infrared Emission Based Temperature Sensor and Light–Off Detector", Oct. 1997, Conf. Proceedings, Advanced Turbine Systems Annual Program Review Meeting, Poster 9.

Center on Airborne Organics, 1997 Annual Report, National Center for Environmental Research, Office of R&D, U.S.Environmental Protection Agency.

Schadow, et al. "Advanced Compact Incinerator Technology Demonstration", Code 474320D, Research & Technology Division, Naval Air Warfare Center Weapons Division, Jan. 1998 last modified.

Khesin et al. "Continuous On–line Monitoring of Unburned Carbon Case Study on a 650 MW Coal–Fired Unit", May 1998, FETC Publications, 1998 USDOE Conf. on Unburned Carbon on Utility Fly Ash.

Mihalcea et al. "Advanced Diode Laser Absorption Sensor in In–Situ Combustion Measurements of CO2, H2O, and Gas Temperature", Jul. 1998, 27th Sym. (Int.) on Combustion.

Gittins et al., Meansurements of Major Species in a High Pressure Gas Turbine Combustion Simulator Using Raman Scattering, AIAA 2000–0772, Jan. 2000.*

Keppeler "Full Scle Carbon Burn–Out and Ammonia Removal Experience", May 2000, USDOE, 2000 Conf. on Unburned Carbon in Fly Ash.*

M.J. Khesin, et al., "Smart Flame Scanners—Myth or Reality?", American Power Conference, Chicago, Apr., 1995.

M.J. Khesin, "Combustion Diagnostics based on Frequency Spectra Analysis", American Flame Research Committee, Monterey, CA, Oct., 1995.

Forney Corporation, "OptiFlame Burner Diagnostic System", 1996.

M.J. Khesin, et al., "Demonstration of New Frequency–Based Flame Monitoring System", American Power Conference, Chicao, Apr., 1996.

M.J. Khesin, et al., "Application of a Flame Spectra Analyzer for Burner Balancing", Sixth International Joint ISA POWID/EPRI Controls and Instrumentation Conference, Baltimore, Jun., 1996.

M.J. Khesin, et al., "Demonstration of New Flame Monitoring System at a Pilot–Scale Gas–Filled Combustion Test Facility", American Flame Research Committee, International Symposium, Baltimore, Md, Sep., 1996.

MK Engineering, Inc., "System may boost combustion efficiency", Industry Watch, Sep., 1996.

M.J. Khesin, et al., "Demonstration Tests of New Burner Diagnostic System on a 650 MW Coal–Fired Utility Boiler", presented at the American Power Conference, Chicago, Apr., 1997.

M.J. Khesin, et al., "Application of a New Burner Diagnostic System for Coal–Fired Utility Boilers", presented to the Joint ISA/EPRI Symposium, Jun., 1997, Knoxville, TN.

MK Engineering, Inc., "Combustion Diagnostic System", illustrated brochure, copyright date of Nov., 1997, but first publicly distributed in Jan., 1998.

MK Engineering, Inc., "MPV–1 Combustion Diagnostic System—A Case Study, Application on a 650 MW Coal–Fired Unit" Jan., 1998.

MK Engineering, Inc., "MPV–1 Combustion Diagnostic System for Tangential Boilers", Jan., 1998.

MK Engineering, Inc., "MPV–1 Combustion Diagnostic System", distributed Feb., 1998.

"Algorithms convert chaos into efficiency", text as printed in Personal Engineering and Instrumentation, Apr., 1998.

* cited by examiner

COMBUSTION DIAGNOSTICS METHOD AND SYSTEM

This application claims the benefit of U.S. Provisional Application No. 60/069,989, filed Dec. 18, 1997.

BACKGROUND OF THE INVENTION

1. Field of the Invention

The present invention relates to combustion diagnostics.

2. Description of Related Art

In numerous industrial environments, a hydrocarbon fuel is burned in stationary combustors (e.g., boilers or furnaces) to produce heat to raise the temperature of a fluid, e.g., water. The fluid may be heated to generate steam, and this steam may be used to drive turbine generators that output electrical power. Such industrial combustors typically employ an array of many individual burner elements to combust the fuel. In addition, various means of combustion control, such as overfire air, staging air, reburning systems, selective non-catalytic reduction systems, can be employed in the post-flame zone of the burner elements to enhance combustion conditions and reduce nitrous oxide (NOx) emission.

For a combustor to operate efficiently and to produce an acceptably complete combustion that generates byproducts falling within the limits imposed by environmental regulations and design constraints, all individual burners in the combustor must operate cleanly and efficiently and all post-combustion systems must be properly balanced and adjusted. Emissions of unburned carbon (i.e., loss-on-ignition (LOI) data), NOx, carbon monoxide and/or other byproducts generally are monitored to ensure compliance with environmental regulations. The monitoring heretofore has been done, by necessity, on the aggregate emissions from the combustor (i.e., the entire burner array, taken as a whole).

Some emissions, such as the concentration of unburned carbon in fly ash, are difficult to monitor on-line and continuously. In most cases, these emissions are measured on a periodic or occasional basis, by extracting a sample of ash and sending the sample to a laboratory for analysis. When a particular combustion byproduct is found to be produced at unacceptably high concentrations, the combustor must be adjusted to restore proper operations. Measurement of the aggregate emissions, or measurement of emissions on a periodic or occasional basis, however, do not provide an indication of what combustor parameters should be changed and/or which combustor zone should be adjusted.

Applicant has recognized that it would be advantageous to achieve continuous, on-line monitoring of important combustion variables and their distribution in different combustion zones. If this monitoring is provided, individual burners and the post-flame combustion controls may be adjusted to provide an optimum, or improved, ratio among the fuel and air flows and to establish a distribution of individual air flows and reburning fuel flows resulting in efficient operation and emissions that are at acceptably low levels.

Applicant's experimental testing has demonstrated that the fluctuating component of burner flame radiation is highly sensitive to changes in combustion conditions and parameters of that fluctuating component can be correlated with combustion variables and can be utilized to monitor, adjust and optimize the individual burners. Existing systems monitor the radiation from burner flame scanners and use signal processing algorithms to calculate combustion parameters based upon the characteristics of the signals output from the flame scanners. Although these systems operate satisfactorily in most situations, Applicant has recognized that the chaotic nature of burner flames tends to cause the combustion parameters calculated by them to be sporadically inconsistent with actual flame conditions. These intermittent inconsistencies can cause a person or system monitoring the parameters to believe falsely that one or more combustion variables require adjusting.

Additionally, Applicant has recognized that existing systems that monitor burner flames do not produce data indicative of the operating conditions of post-flame combustion systems, such as overfire air, staging air and reburning systems. These post-flame systems simply do not affect the condition of burner flames in a manner that is detectable by existing flame scanners and associated flame analysis systems. Existing flame analysis systems therefore are incapable of accurately monitoring the operation of such post-flame combustion systems and providing information regarding the failure or non-optimal operation thereof.

Also, Applicant has recognized that certain important combustion variables, such as the concentration of unburned carbon in fly ash, are difficult or even impossible to determine from flame scanners looking into the burner ignition zone because these parameters are formed outside of the ignition zone. Existing flame analysis systems therefore are incapable of accurately measuring such post-flame combustion variables.

Further, existing systems may employ frequency-domain analysis of flame scanner output signals. Such systems require instrumentation to transform time-domain signals into the frequency-domain. This instrumentation can be complicated and expensive. While these systems are capable of achieving accurate results, situations can be envisioned in which a lower cost system not requiring time-to-frequency-domain transformation instrumentation would be useful.

Sensors used to monitor flame conditions are susceptible to damage by combustibles or hot gases that come into contact with them. Sensors generally are placed in locations at which they are least likely to be damaged by these elements, and usually require continuous protection, e.g. by supplying purging or cooling air. The conventional manner in which scanners are mounted to monitor flame conditions leaves the scanners vulnerable to attack by potentially damaging flame-related forces and combustion products. In conventional systems, it is therefore difficult to maintain sensors in proper working condition, and frequent maintenance is required to be performed.

What is needed, therefore, is an improved system, apparatus and method for evaluating one or more combustion variables.

SUMMARY OF THE INVENTION

According to one aspect of the present invention, a method for analyzing operation of a combustor includes the steps of: (a) monitoring radiation emitted from a post-flame zone of the combustor, and (b) in response to a fluctuational component of the monitored radiation, calculating one or more combustion parameters.

According to another aspect of the invention, a method for analyzing operation of a combustor includes the steps of: (a) monitoring radiation emitted from the post-flame zone of the combustor; (b) generating a function that includes at least two extremum points, the function having a shape that changes in response to changes in a fluctuational component of the monitored radiation; and (c) using at least one coordinate of each of the at least two extremum points to calculate one or more combustion parameters.

According to another aspect, a method for analyzing operation of a combustor includes the steps of: (a) monitoring radiation emitted from the post-flame zone of the combustor; (b) analyzing a fluctuational component of the monitored radiation according to a first algorithm; (c) analyzing the fluctuational component of the monitored radiation according to a second algorithm; and (d) combining results of the first and second algorithms to calculate one or more combustion parameters.

According to yet another aspect, a method for analyzing operation of a combustor includes the steps of: (a) monitoring radiation emitted within the combustor; (b) producing a time-domain signal representing a measured amplitude of the monitored radiation; (c) calculating an average amplitude of the signal during a particular time period; (d) counting the number of high peaks in the signal that, during the particular time period, achieve an amplitude, relative to the average amplitude, that is greater than a first threshold, and/or a number of low peaks in the signal that, during the particular time period, achieve an amplitude, relative to the average amplitude, that is less than a second threshold; and (e) using the number of high peaks and/or the number of low peaks counted in step (d) to calculate one or more combustion parameters.

According to another aspect of the invention, a method for monitoring an amount of unburned carbon in fly ash includes the step of using an output of a radiation sensor monitoring radiation emitted from a post-flame zone of a combustor to monitor the amount of unburned carbon in fly ash.

According to yet another aspect, a method for analyzing operation of a combustor includes the steps of: (a) using a first radiation sensor, that is sensitive to a first portion of an electromagnetic spectrum, to monitor radiation emitted from the post-flame zone of the combustor; (b) using a second radiation sensor, that is sensitive to a second portion of the electromagnetic spectrum which is different from the first portion, to monitor radiation emitted from the post-flame zone of the combustor; and (c) in response to outputs of each of the first and second radiation sensors, calculating one or more combustion parameters.

According to another aspect of the present invention, a system for analyzing operation of a combustor includes: at least one radiation sensor arranged to monitor radiation emitted from a post-flame zone of the combustor and to produce a signal indicative thereof; and means for calculating at least one combustion parameter in response to a fluctuational component of the signal.

According to another aspect of the invention, a system for analyzing operation of a combustor includes: at least one radiation sensor to monitor radiation emitted from a post-flame zone of the combustor and to produce a signal indicative thereof; means for generating a function that includes at least two extremum points having a shape that changes in response to changes in the fluctuational component of the signal; and means for using at least one coordinate of each of the at least two extremum points calculate at least one combustion parameter.

According to another aspect, a system for analyzing operation of a combustor includes: at least one radiation sensor to monitor radiation emitted from a post-flame zone of the combustor and to produce a signal indicative thereof; means for analyzing a fluctuational component of the signal according to a first algorithm; means for analyzing the fluctuational component of the signal according to a second algorithm; and means for combining results of the first and second algorithms to calculate at least one combined combustion parameter.

According to yet another aspect of the invention, a system for analyzing operation of a combustor includes: at least one radiation sensor to monitor radiation emitted within the combustor and to produce a signal indicative thereof; means for calculating an average amplitude of the signal during a particular time period; and means for counting a number of high peaks in the signal that, during the particular time period, achieve an amplitude, relative to the average amplitude, that is greater than a first threshold, and/or a number of low peaks in the signal that, during the particular time period, achieve an amplitude, relative to the average amplitude, that is less than a second threshold; and means for using the number of high peaks and/or the number of low peaks counted by the means for counting to calculate at least one combustion parameter.

According to another aspect, a system for monitoring an amount of unburned carbon generated by a combustor includes: at least one radiation sensor to monitor radiation emitted from a post-flame zone of the combustor and to produce a signal indicative thereof; and means for using the signal to monitor the amount of unburned carbon generated by the combustor.

According to another aspect of the invention, a system for analyzing operation of a combustor includes: at least one first radiation sensor, that is sensitive to a first portion of an electromagnetic spectrum, to monitor radiation emitted from a post-flame zone of the combustor; at least one second radiation sensor, that is sensitive to a second portion of the electromagnetic spectrum which is different from the first portion, to monitor radiation emitted from a post-flame zone of the combustor; and means for calculating at least one combined combustion parameter in response to outputs of each of the first and second radiation sensors.

According to another aspect of the present invention, a computer-readable medium for use with a processor is disclosed. The medium has a plurality of instructions stored thereon which, when executed by the processor, cause the processor to perform the steps of: (a) in response to a fluctuational component of a signal generated by a radiation sensor the combustor, generating a function that includes at least two extremum points, the function having a shape that changes in response to changes in a fluctuational component of the signal; and (b) using at least one coordinate of each of the at least two extremum points to calculate at least one combustion parameter.

According to another aspect of the invention, a computer-readable medium for use with a processor is disclosed. The medium has a plurality of instructions stored thereon which, when executed by the processor, cause the processor to perform the steps of; (a) analyzing a fluctuational component of a signal generated by a radiation sensor monitoring radiation emitted from a post-flame zone of the combustor according to a first algorithm; (b) analyzing the fluctuational component of the signal according to a second algorithm; and (c) combining results of the first and second algorithms to calculate at least one combined combustion parameter.

According to another aspect, a computer-readable medium for use with a processor is disclosed. The medium has a plurality of instructions stored thereon which, when executed by the processor, cause the processor to perform the steps of: (a) calculating an average amplitude of a signal generated by a radiation sensor during a particular time period; (b) counting a number of high peaks in the signal that, during the particular time period, achieve an amplitude, relative to the average amplitude, that is greater than a first threshold, and/or a number of low peaks in the signal that, during the particular time period, achieve an amplitude, relative to the average amplitude, that is less than a second threshold; and (c) using the number of high peaks and/or the number of low peaks counted in step (b) to calculate at least one combustion parameter.

According to yet another aspect, a computer-readable medium for use with a processor is disclosed. The medium has a plurality of instructions stored thereon which, when executed by the processor, cause the processor to perform the step of using an output of a radiation sensor to monitor an amount of unburned carbon in fly ash.

According to another aspect of the present invention, a system for supporting a sensor near an outer surface of a combustor such that the sensor may sense combustion activity inside the combustor includes: a casing, forming a first channel through which gaseous matter may pass, and a member, forming a second channel, adapted to have a radiation sensor mounted thereto. When the apparatus is mounted on the combustor and the radiation sensor is mounted to the member, the second channel defines an unobstructed linear path that extends between the radiation sensor and a position inside the combustor, the unobstructed linear path intersecting at least a portion of the first channel.

DETAILED DESCRIPTION OF THE INVENTION

Figure 1:
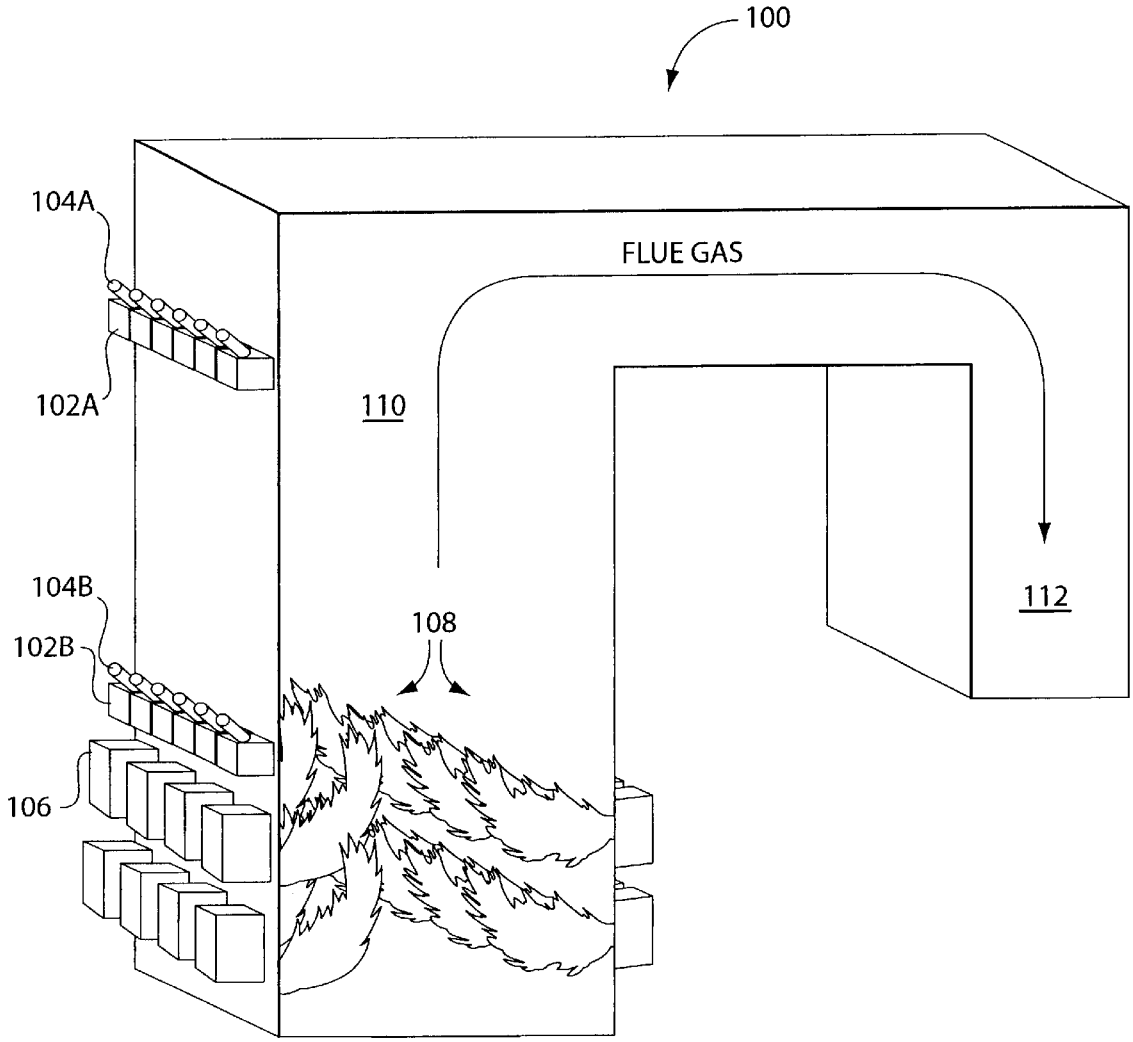
FIG. 1 is a diagram showing a perspective view of a combustor with which an embodiment of the present invention may be employed.

FIG. 1 shows a combustor 100 with which an embodiment of the present invention may be employed. According to one embodiment, combustor 100 may be on the order of hundreds of feet tall. As shown, combustor 100 may include a plurality of combustion devices (e.g., combustion device 106) which mix fuel and air to generate flame in a flame envelope 108 within the combustor 100. The combustion devices may include any of numerous types of flame-producing devices, and the invention is not limited to a particular type. According to one embodiment, for example, the combustion devices may include burners (e.g., gas-fired burners, coal-fired burners, oil-fired burners, etc.). In such an embodiment, the burners may be arranged in any manner, and the invention is not limited to any particular arrangement. For example, the burners may be situated in a wall-fired, opposite-fired, tangential-fired, or cyclone arrangement, and may be arranged to generate a plurality of distinct flames, a common fireball, or any combination thereof. Alternatively, a combustion device called a "traveling grate" may be employed to generate flame within the combustor 100. A traveling grate is a device that uses a flame-resistant grate resembling a conveyor belt to convey coal or another fuel into a combustion area of the combustor 100.

As defined in a publication by the National Fire Protection Association (NFPA) of Quincy, Mass., entitled "NFPA 85C, an American National Standard," p. 85C-11, Aug. 16, 1991, "flame" refers to "the visible or other physical evidence of the chemical process of rapidly converting fuel and air into products of combustion, and a "flame envelope" refers to "the confines (not necessarily visible) of an independent process converting fuel and air into products of combustion." Outside flame envelope 108, hot combustion gases and combustion products may be turbulently thrust about. These hot combustion gases and products, collectively called "flue gas," make their way away from flame envelope 108 toward an exit 112 of combustor 100. Water or another fluid (not shown) may flow through the walls of combustor 100 where it may be heated, converted to steam, and used to generate energy, for example to drive a turbine.

When combustion devices 106 in combustor 100 are actively burning fuel, radiation is emitted from two distinct locations: (1) from flame envelope 108, and (2) from a so-called "post-flame" zone 110, which is the zone outside of flame envelope 108 spanning some distance toward exit 112. The average magnitude of this emitted radiation is indicative of the temperature of the matter at the location from which the radiation is being emitted. Because the temperature in flame envelope 108 generally is significantly higher than the temperature in post-flame zone 110, the average magnitude of the radiation emitted from post-flame zone 110 tends to be substantially lower than the average magnitude of the radiation emitted from flame envelope 108.

The turbulence that occurs both in flame envelope 108 and in post-flame zone 110 causes the magnitude of the radiation to fluctuate. The turbulence within flame envelope 108 may be driven in large part by small scale eddies that are formed during the fuel-air mixing process and the formation and destruction of NOx and combustibles. These turbulent activities can therefore be quite intense and chaotic within flame envelope 108. This turbulence has been experimentally shown to reflect various combustion parameters. That is, by analyzing the fluctuational component of a signal from a radiation sensor monitoring flame envelope 108, combustion parameters associated with these small-scale eddies, as well combustion parameters associated with other turbulence in flame envelope 108, can be measured.

The turbulence in post-flame zone 110, on the other hand, tends to be less intense and chaotic than the turbulence within flame envelope 108. One reason for this lower turbulence is that the small eddies associated with combustion kinetics and fuel-air mixing tend to dissipate in post-flame zone 110. The remaining large-scale eddies in post-flame zone 110 have been found to reflect post-flame combustion variables, particularly those associated with so-called secondary combustion processes. In this regard, Applicant has recognized that the low-frequency fluctuating component of a signal generated by a radiation sensor aimed into the post-flame flue gas stream in post-flame zone 110 can be sensitive to changes in post-flame combustion conditions.

According to one embodiment of the present invention, a fluctuational component of a signal output from a radiation sensor monitoring post-flame zone 110 may be analyzed and one or more combustion parameters may be calculated based upon its characteristics. These combustion parameters may be correlated with particular post-flame combustion variables, such as unburned carbon in fly ash. Such correlation may be accomplished, for example, by comparing several empirically measured values of a post-flame combustion variable (e.g., measured amounts of unburned carbon in fly ash) with concurrently-derived combustion parameters and identifying correlations therebetween. Once this correlation has been accomplished for each combustion variable, that combustion variable may be monitored simply by monitoring the combustion parameter with which it is correlated. In this manner, post-flame combustion control systems, such as overfire air and reburning, can be controlled so as to optimize the operation of combustor 100 and to minimize undesirable combustion byproducts, such as unburned carbon and combustibles.

As shown in FIG. 1, according to one exemplary embodiment, upper sensor boxes (e.g., sensor box 102A) and lower sensor boxes (e.g., sensor box 102B) may be mounted on combustor 100. The upper and lower sensor boxes may include sensor pipes (e.g., sensor pipes 104A and 104B) in which radiation sensors may be mounted. An exemplary embodiment of these sensor boxes is described below in connection with the description of FIGS. 9A and 9B. It should be appreciated, however, that the sensors boxes are an optional feature and need not be employed in connection with all embodiments of the invention. The upper sensor boxes (e.g., sensor box 102A) may be positioned across the width of combustor 100 (or be otherwise positioned about its perimeter) in the combustor exit area, downstream of the post-flame zone, so as to permit the sensors mounted therein to monitor the radiation emitted from the stream of hot flue gases in post-flame zone 110. The lower sensor boxes may be positioned across the width of combustor 100 (or be otherwise positioned about its perimeter) in the combustor's combustion area so as to permit the sensors mounted therein to monitor the radiation emitted from within flame envelope 108. Any number of radiation sensors may be installed across and/or around the upper and lower portions of combustor 100 to monitor the distribution profile of combustion variables.

The radiation sensors mounted in upper and lower sensor boxes produce electric signals indicative of the radiation being emitted from within post-flame zone 110 and from within flame envelope 108, respectively. These signals include two principal components: intensity (DC component) and fluctuating frequency (AC component). The AC component of each of these signals may be extracted and used to generate, via dynamic signal processing, one or more statistical, or characteristic, functions. As explained in more detail below, these statistical (characteristic) functions may be derived from frequency-domain or time-domain representations of the signals in conjunction with corrections imposed by specific operating conditions, such as the effects of combustor load, type of combustion device, or type of fuel. Each of these functions may be correlated with one or more combustion variables. An array of parameters may then be calculated from these statistical functions to characterize various combustion variables.

The overall combustion process represents a complex phenomenon which comprises and depends on many different operating factors, physical parameters and chemical reactions. The chaotic nature of the combustion process tends to cause the combustion parameters calculated by a single mathematical algorithm to be sporadically inconsistent with actual flame conditions. In order to reduce the effects of these sporadic inconsistencies, two or more such functions (each employing a mathematically different algorithm), may be combined to yield a single, more stable combustion parameter.

Additionally, because of the chaotic nature of the combustion process, a radiation sensor that is sensitive to a particular portion of the electromagnetic spectrum may at one moment produce an output signal that can be used to calculate a combustion variable that is consistent with actual flame conditions, while at another moment it may produce an output signal that may not so be used. For this reason, one embodiment of the invention employs at least two radiation sensors, or groups of sensors, that are sensitive to different portions of the electromagnetic spectrum. Outputs of these radiation sensors together may be used to generate a single combustion parameter that can more accurately correlate with current combustion conditions than could a combustion parameter calculated using an output of only one of the sensors.

Figure 2:
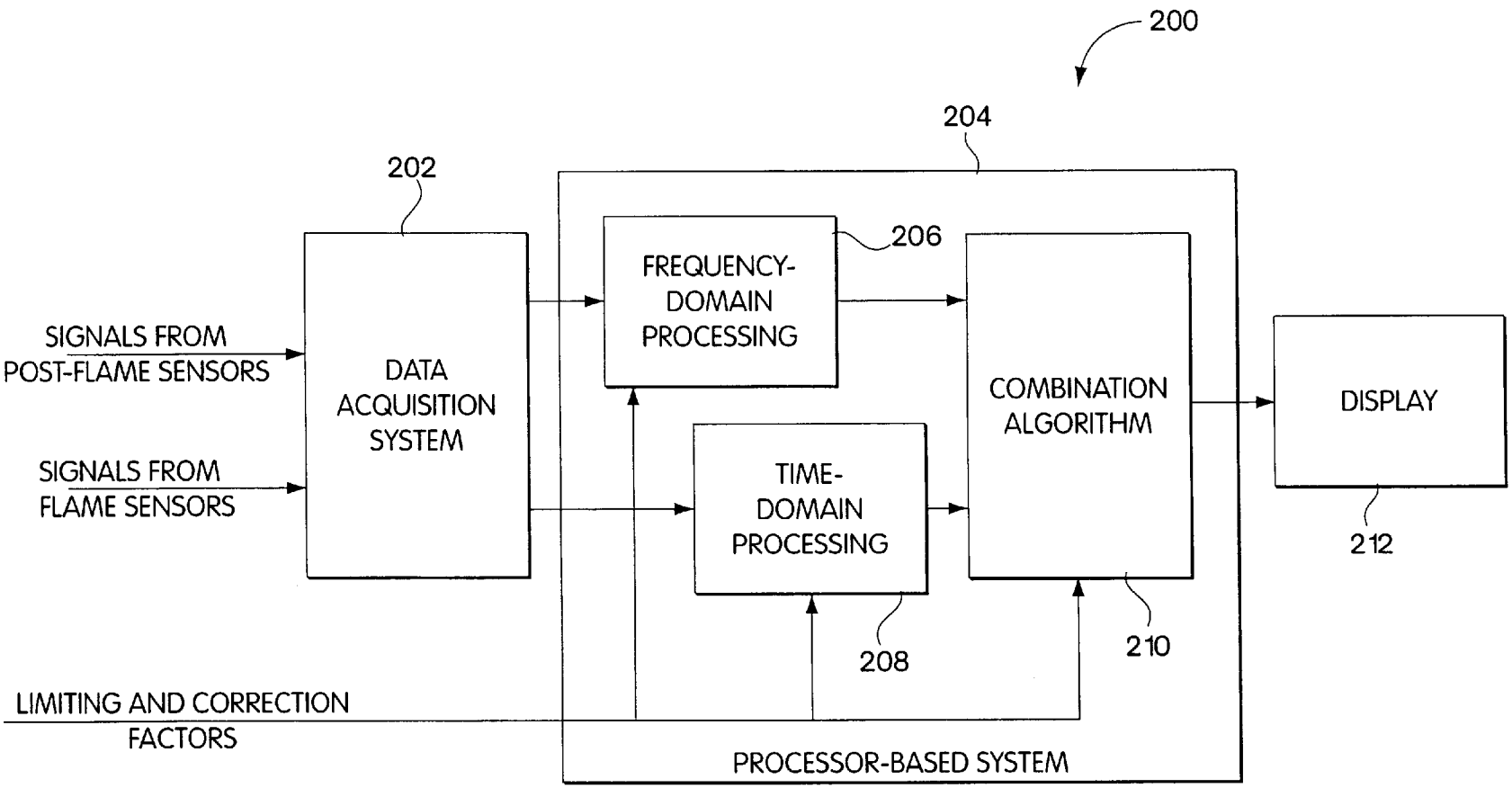
FIG. 2 is a block diagram showing a system that may be used in connection with an embodiment of the invention.

FIG. 2 is a block diagram showing a system 200 for monitoring the operation of combustor 100 according to one embodiment of the present invention. As shown, system 200 may include a data acquisition system 202, a processor-based system 204, and a display 212. Processor-based system 204 may include a processor and a memory, as well as circuitry to support the operation of each, or may be implemented using any other combination of hardware, firmware, and/or software.

Processor-based system 204 may include a frequency-domain processing section 206, a time-domain processing section 208, and a combination algorithm section 210. It should be appreciated, however, that, according to different embodiments of the invention, processor-based system 204 need not employ each of these sections and may employ frequency-domain processing section 206 or time-domain processing section 208 separately. According to one embodiment, each of these sections may include instructions stored in the memory, which when executed by the processor, cause the processor to perform the function represented by the section; these sections may thus be viewed as functional blocks which need not be separate hardware. In the embodiment shown, data acquisition system 202 is separate from processor-based system 204, but it should be appreciated that the function of data acquisition system 202 may also be implemented within processor-based system 204.

As shown, data acquisition system 202 may receive signals from: (1) sensors arranged to monitor radiation from post-flame zone 110 of combustor 100, and (2) sensors arranged to monitor radiation from flame envelope 108 in combustor 100. Data acquisition system 202 may convert these signals into digital data and may pass this digital data to each of frequency-domain processing section 206 and time-domain processing section 208. Data acquisition system 202 may sample the analog input signal, for example, at 1000 Hertz or another suitable frequency. Frequency-domain processing section 206 and time-domain processing section 208 also may receive limiting and correction factors, based upon boiler load, type and number of combustion devices, type of fuel, etc., which may be used by each section in calculating combustion-related parameters based upon the received signals.

Combination algorithm section 210 may receive parameters calculated by each of frequency-domain processing section 206 and time-domain processing section 208 for each of the input signals. The user may select particular ones of the generated parameters for display on display 212, or may elect for combination algorithm section 210 to combine two or more of them according to an user selection of one or more predetermined algorithms and display the result on display 212. Additionally, the signals used by either of frequency-domain processing section 206 or time-domain processing section 208 may be from radiation sensors having different spectral sensitivities, so that combination algorithm section 210 can combine parameters calculated using these different signals to calculate combustion parameters that more consistently correlate with actual combustion conditions, as discussed above.

Combination algorithm section 210 also may receive limiting and correction factors, based upon fuel type, combustor load, etc., pursuant to which it can adjust its combination algorithms accordingly. For example, combination algorithm section 210 may calculate a product of: (1) one or more parameters generated by frequency-domain processing section 206, and (2) one or more parameters generated by time-domain processing section 208, with each parameter being weighted (i.e., multiplied) by an appropriate correction factor.

Figure 3:
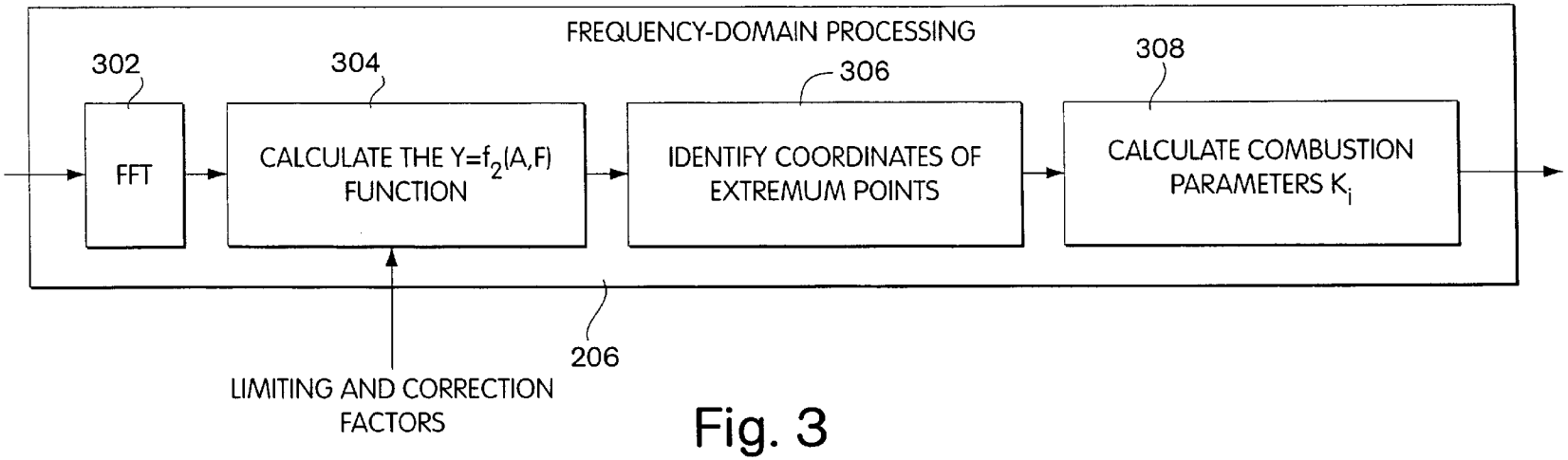
FIG. 3 is a block diagram showing an exemplary embodiment of the frequency-domain processing section shown in FIG. 2.

FIG. 3 is a functional block diagram showing several functions (hereafter "blocks") that may be performed by frequency-domain processing section 206 of processor-based system 204 for each of the digital input signals it receives from data acquisition system 202. As shown, Fast-Fourier transform (FFT) block 302 may receive digital data from data acquisition system 202, convert the data into a frequency-domain amplitude spectrum $A=f_1(F)$(i.e., the amplitude "A" is equal to the function "$f_1$" of the frequency "F"), and provide this frequency-domain amplitude spectrum $A=f_1(F)$ to block 304.

Block 304 may then generate a curve $Y=f_2(F,A)$(i.e., the variable "Y" is equal to the function "$f_2$" of the frequency "F" and the amplitude "A") having at least one extremum value, i.e., a point on the curve where its first derivative is equal to zero, as follows. First, a three-dimensional surface "S" is defined by an equation having both amplitude (A) and frequency (F) as variables, i.e., $S=f_3(A,F)$. For example, surface S may be defined as $S=m*A^i+n*F^j$, wherein m, n, i, and j are variables defined by the user according to combustor variables, e.g., fuel type, combustor load, etc., and "*" is the multiplication operator.

Next, the frequency-domain amplitude spectrum $A=f_1(F)$ at a given moment in time may be mapped onto the surface $S=f_3(A,F)$ to define the curve $Y=f_2(A,F)$ in the surface S. This may accomplished, for example, by calculating a value of $S=f_3(A,F)$ for each point in the frequency-domain amplitude spectrum $A=f_1(F)$ at the given moment in time. According to one embodiment, surface S may have one positive extremum value, i.e., a point on surface S where partial derivatives in the directions of the A and F coordinate axes are both equal to zero and where partial second derivatives in the directions of the A and F coordinate axes are negative, and one negative extremum value, i.e., a point on surface S where partial derivatives in the directions of the A and F coordinate axes are both equal to zero and where partial second derivatives in the directions of the A and F coordinate axes are positive. Therefore, according to this embodiment, the curve Y in the surface S will generally also have one positive extremum value, i.e., a point on the curve Y where its first derivative is equal to zero and its second derivative is negative, and one negative extremum point, i.e., a point on the curve Y where its first derivative is zero and its second derivative is positive.

Figure 4:
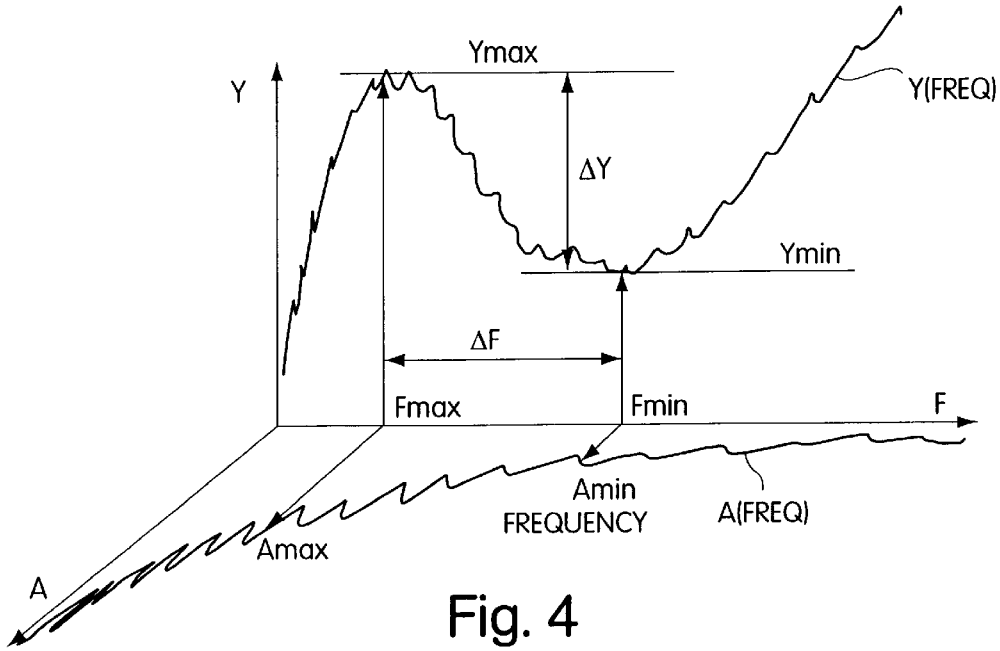
FIG. 4 is a graph showing a function, having two extremum points, that may be generated in connection with an embodiment of the invention.

FIG. 4 illustrates how the frequency domain amplitude spectrum A and the extremum function Y might appear at a given moment in time in relation to the frequency coordinate axis of the frequency-domain amplitude spectrum $A=f_1(F)$ after the values of the frequency-domain amplitude spectrum at the moment in time have been mapped onto surface S. It should be appreciated that a similar relationship also would exist between the function Y and the amplitude coordinate axis of the frequency-domain amplitude spectrum $A=f_1(F)$ at the moment in time so that a similar curve could also be generated showing this relationship as well.

As shown in FIG. 4, at any moment in time, curve Y may have a positive extremum value $Y_{max}$ corresponding to a point on the frequency-domain amplitude spectrum $A=f_1(F)$ occurring at a frequency $F_{max}$ and an amplitude $A_{max}$, and may have a negative extremum value $Y_{min}$ corresponding to a point on the frequency-domain amplitude spectrum $A=f_1(F)$ occurring at a frequency $F_{min}$ and an amplitude $A_{min}$.

Referring again to FIG. 3, according to one embodiment of the invention, block 306 may calculate coordinates of the reference points $Y_{max}$, $Y_{min}$, $F_{max}$ and $F_{min}$, and block 308 may calculate various relationships between these coordinates. For example, block 308 may calculate parameters $K_i$ defined as: (1) the sums of or ratios between the values $Y_{max}$ and $Y_{min}$ or $F_{max}$ and $F_{min}$, or (2) the value $\Delta Y/\Delta F=(Y_{max}-Y_{min})/(F_{min}-F_{max})$, wherein "i" denotes an integer that is unique for each defined combustion parameter "K." It should be appreciated, however, that many additional parameters $K_i$ may be defined using the coordinates $Y_{max}$, $Y_{min}$, $F_{max}$ and $F_{min}$, and that the coordinates $A_{min}$ and $A_{max}$ may also be used to define such parameters.

By determining experimentally which parameters, calculated as described above, correlate with which combustion variables, the condition of various combustion variables may be monitored simply by monitoring the calculated combustion parameters. It has been experimentally shown that combustion parameters $K_i$ defined by the equations $K_1=Y_{max}+Y_{min}$ and $K_2=(\Delta Y/\Delta F)$ correlate with specific combustion variables. It should be noted that the degree of these correlations may depend on the spectral sensitivity of the radiation sensor being used to monitor a zone of combustor 110.

After calculating combustion parameters $K_1$, frequency-domain processing section 206 may pass calculated combustion parameters $K_i$ to combination algorithm section 210 of processor-based system 204 (FIG. 2) for further processing, as described below.

Figure 5:
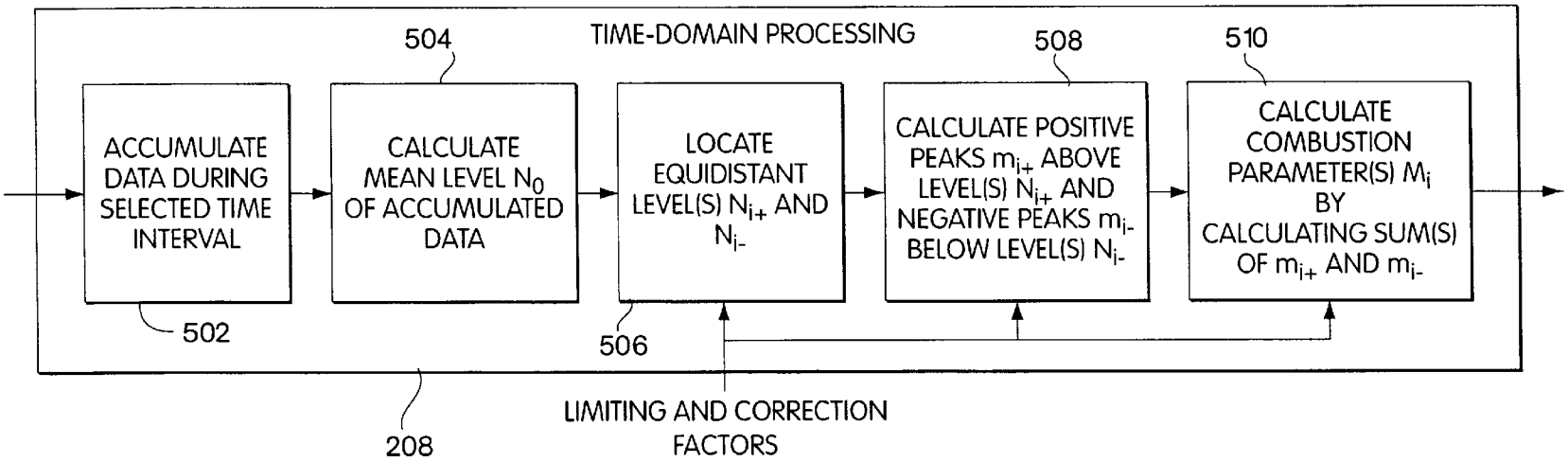
FIG. 5 is a block diagram showing an exemplary embodiment of the time-domain processing section shown in FIG. 2.

FIG. 5 is a functional block diagram showing several functions (hereafter "blocks") that may be performed by time-domain processing section 208 of processor-based system 204 for each of the digital input signals it receives from data acquisition system 202. As shown, block 502 may accumulate digital data received from data acquisition system 202 during a selected time interval. For example, block 502 may accumulate data during a two-second time interval.

Figure 6:
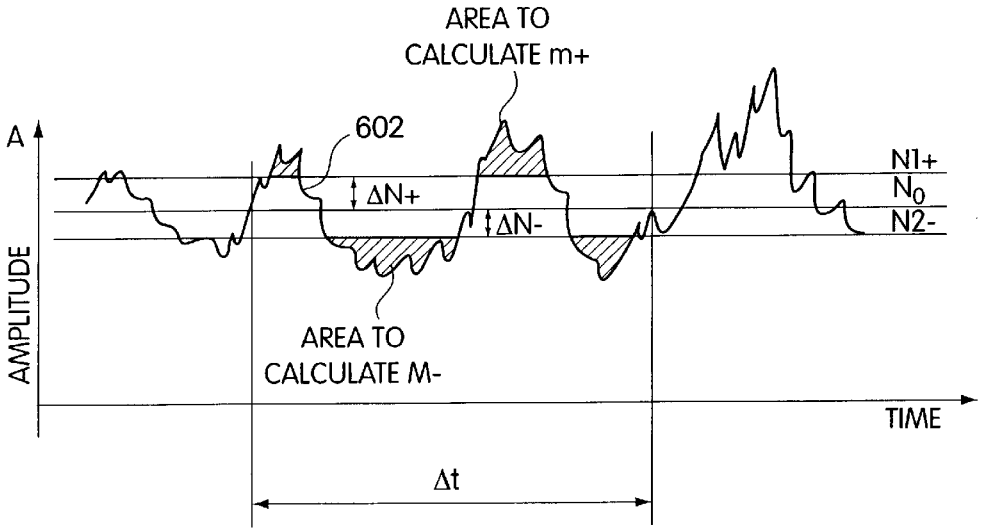
FIG. 6 is a graph showing an exemplary signal from a radiation sensor and how this signal may be processed in connection with an embodiment of the invention.

If data acquisition system 202 (FIG. 2) samples data at "800" Hertz, then "4,000" samples will be accumulated during a five-second interval. FIG. 6 illustrates how an analog signal 602 from a flame sensor may appear during a time period Δt (e.g., five seconds) during which samples of it are accumulated by block 502.

After the time interval At has passed and block 502 has accumulated, for example, five-seconds of data, blocks 504, 506, 508 and 510 proceed to process the data to calculate one or more combustion parameters. Therefore, during each time period during which block 502 is accumulating data, blocks 504, 506, 508 and 510 may be processing data that was accumulated by block 502 during a previous time period.

Referring to FIG. 5, to process the data accumulated by block 502, block 504 may first calculate a mean level $N_0$ of the data accumulated during the time interval Δt. For example, if "4,000" samples were accumulated by block 502, block 504 may calculate the average value of those "4,000" samples to calculate the mean level $N_0$.

Next, block 506 may locate lines $N_{i+}$and $N_{i-}$, which may, but need not, be located an equal distance (on the amplitude axis) from mean level $N_0$. The location of lines $N_{i+}$, and $N_{i-}$, may, for example, be determined by locating the samples that have amplitudes that are, respectively, the most positive and the most negative with respect to the mean level $N_0$, and locating one or more lines $N_{i+}$and $N_{i-}$at distances (on the amplitude axis) above and below mean line $N_0$ equal to predetermined percentages of the differences between the amplitudes of the most positive and negative samples and the mean line $N_0$. For example, lines $N_{i+}$, may be located, one-fourth, one-half, and three quarters of the way between the amplitude of the most positive sample and the mean line $N_0$ and lines $N_{i-}$may be located, one-fourth, one-half, and three quarters of the way between the amplitude of the most negative sample and the mean line $N_0$. The optimum number of lines and distances between the lines depends on type of fuel and combustor design. In the example shown in FIG. 6, a single line $N_{1+}$, is located above mean line $N_0$ and a single line $N_{1-}$ is located below mean line $N_0$.

Next, block 508 may calculate one or more numbers of positive peaks $m_{i+}$, above the one or more positive levels $N_{i+}$, respectively, and may calculate one or more numbers of negative peaks $m_{i-}$below the one or more negative levels $N_{i-}$, respectively. For example, using the example shown in FIG. 6, block 508 may calculate the number of positive peaks $m_{1+}$above line $N_1$, by counting the number of points on curve 602 above line $N_{1+}$at which the first derivative of curve 602 changes signs, and may calculate the number of negative peaks $m_{1-}$below line $N_{1-}$by counting the number of points on curve 602 below line $N_{1-}$at which the first derivative of curve 602 changes signs. It should be noted that the ability of block 508 to identify positive and negative peaks in the samples taken of curve 602 is limited by the sampling rate of data acquisition system 202.

If more than one positive line $N_{i-}$or more than one negative line $N_{i-}$is used, either the numbers of peaks above or below each of the lines may be counted separately, or the numbers peaks occurring between adjacent ones of the positive lines $N_{i+}$(and above the most positive one of lines $N_{i+}$) or between adjacent ones of the negative lines $N_{i-}$(and below the most negative one of lines $N_{i-}$) may be counted separately. It should be appreciated that any other method of counting peaks above, below or between lines may alternatively be employed by block 508 to yield one or more counted numbers of peaks.

Finally, block 510 may calculate one or more combustion parameters $M_i$ based upon the numbers $m_{i+}$and $m_{i-}$counted by block 508. For example, sums or products of one or more combinations of the numbers $m_{i+}$and $m_{1-}$may be calculated to yield one or more combustion parameters $M_i$. Limiting and correction factors, based upon fuel type, combustor load, etc., may be used to properly weight selected ones of numbers $m_{i+}$and $m_{i-}$or to otherwise perform mathematical calculations using these numbers to yield combustion parameter(s) $M_i$. According to one example, a single positive line $N_{1+}$and a single negative line $N_{1-}$may be used and the number of positive peaks $m_{1+}$and the number of negative peaks $m_{1-}$may be added together to calculate a single combustion parameter $M_{1-}$.

Parameters $M_i$ calculated in this manner may, based on experimental data, be correlated with combustion variables. This correlation may depend on the spectral sensitivity of the optical sensor. For example, for a post-flame sensor that is sensitive mostly to the visible spectrum, the parameter $M_i$ may tend to correlate with concentration of unburned carbon in fly ash.

According to one embodiment, the range of samples accumulated during a time interval, e.g., time interval Δt (FIG. 6), may be divided into several constituent ranges, e.g., fifty to seventy ranges, corresponding to constituent time intervals of the time interval Δt. One or more combustion parameters $M_i$ may then be calculated for each of these constituent ranges. By ranking (by value) the combustion parameters calculated for all of the constituent ranges and selecting a combustion parameter having a particular rank, e.g., number ten out of sixty, the selected combustion parameter may correlate accurately with a combustion variable.

As noted above, combination algorithm section 210 of processor-based system 204 may combine one or more of combustion parameters $K_i$ generated by frequency-domain processing section 206 and/or one or more combustion parameters $M_i$ generated by time-domain processing section 208 in order to present to a user (e.g., via display 212) a representative and reliable indication of current combustion conditions.

Figure 7A:
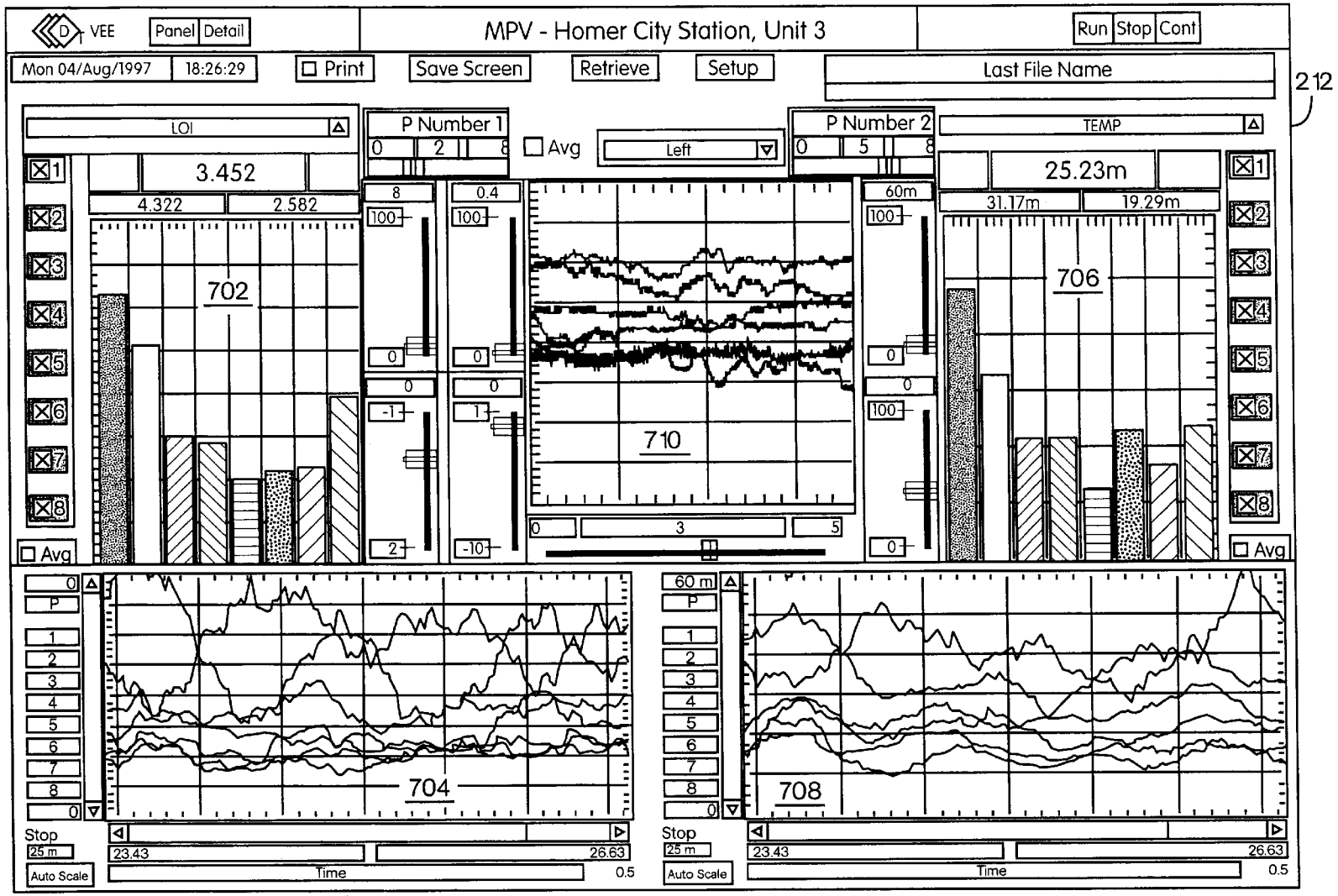
FIGS. 7*a–b* are illustrations showing examples of how information may be displayed to a user in connection with an embodiment of the invention.

FIG. 7*a* illustrates an example of how information regarding the concentration of unburned carbon in fly ash (i.e., loss-on-ignition (LOI) data) in a coal-fired combustor may be displayed to a user on display 212 (FIG. 2) according to one embodiment of the invention. As shown, this information may be displayed in a bar graph form (area 702) or a trend form (area 704), or both. Display 212 also may concurrently display information regarding temperature distribution in the combustor in a bar graph form (area 706) or a trend form (area 708). The raw signals (area 710) may also concurrently be displayed so that the user may monitor the status of the sensors. If one of the sensors becomes plugged or damaged, the operator will immediately see that its raw signal has become abnormal.

Figure 7B:
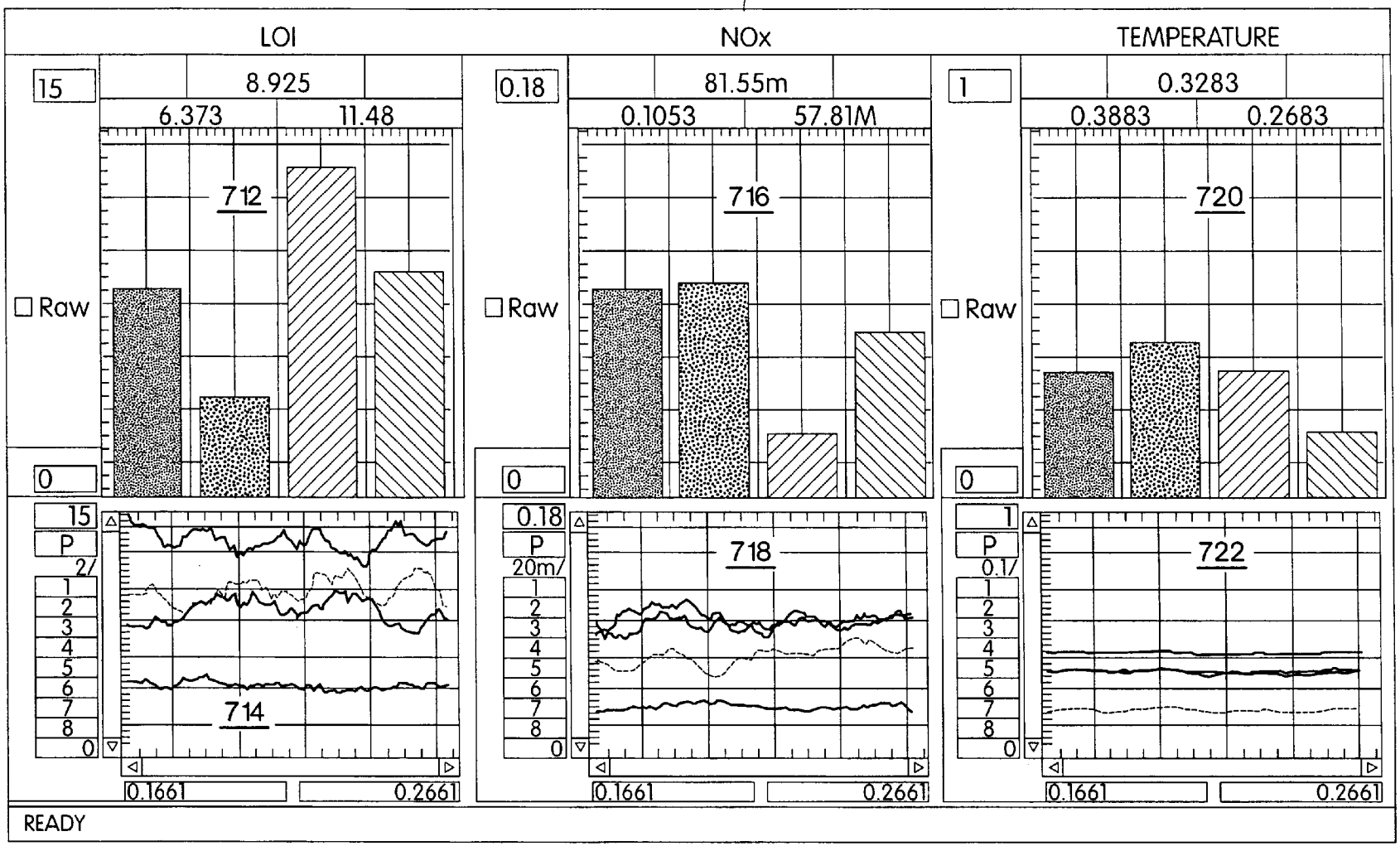

FIG. 7*b* illustrates an example of how information regarding the NOx concentration in a coal-fired combustor, in addition to information regarding the LOI concentration and the temperature distribution in the combustor, may be displayed to a user on display 212 (FIG. 2) according to one embodiment of the invention. As shown, the LOI, NOx, and temperature readings may be displayed to the user in bar graph form (areas 712, 714, and 720, respectively), or may be displayed in trend form (areas 714, 718, and 722, respectively).

Figure 8A:
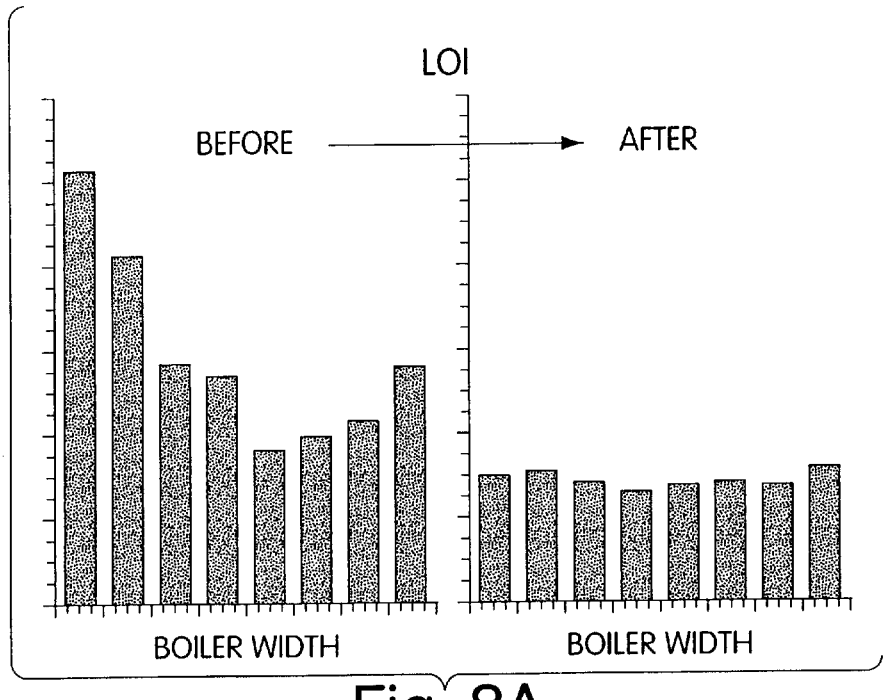
FIGS. 8*a* and 8*b* are charts showing how information displayed to a user may be used to perform boiler balancing in connection with an embodiment of the invention.
Figure 8B:
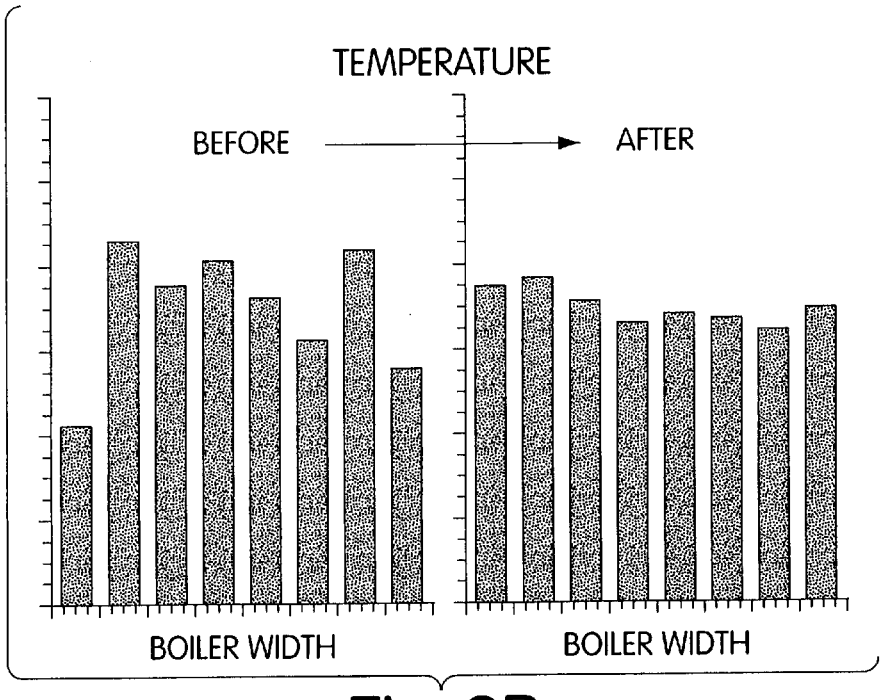

FIGS. 8*a* and 8*b* illustrate how information regarding unburned carbon in fly ash (i.e., loss-on-ignition (LOI) data), as measured according to an embodiment of the invention, and flue-gas temperature distribution may be displayed to a user on display 212 (FIG. 2) and used to perform combustor balancing. Because the user may be provided with continuous, on-line information regarding these variables, the user can adjust the operating conditions of the combustor's combustion devices until the displayed parameters (i.e., LOI and temperature) are substantially level across the "width" of the combustor.

Figure 9A:
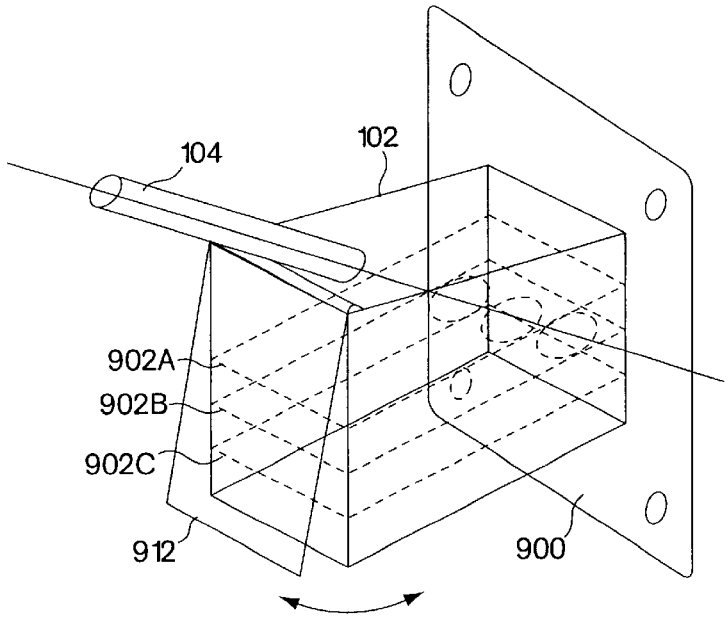
FIGS. 9*a* and 9*b* are diagrams showing an exemplary embodiment of one of the sensor mounting boxes shown in FIG. 1.
Figure 9B:
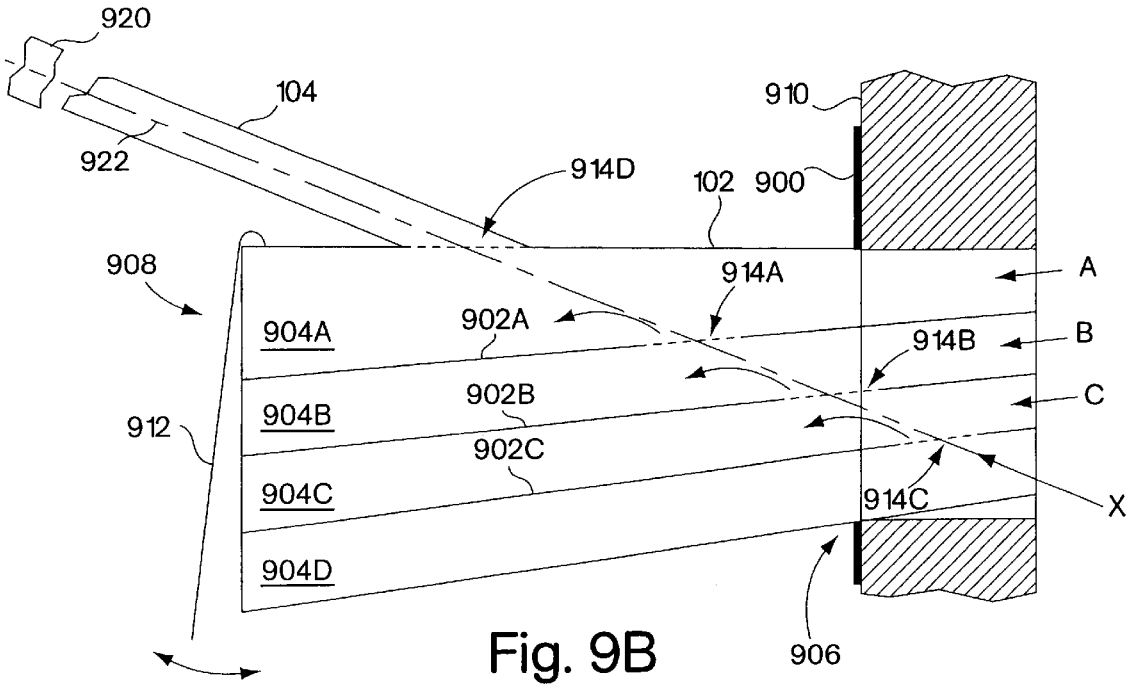

As discussed above, any sensor that is aimed into a harsh combustor environment needs to be protected from fouling, plugging and ash deposits. Usually, such protection is achieved by supplying a stream of cooling air in front of the sensor. According to one embodiment of the present invention, a special sensor mounting box may be employed to provide reliable long-term operation without requiring cooling air to be supplied. An exemplary embodiment of such a sensor box 102 is shown in FIGS. 9*a* and 9*b*.

According to one embodiment, sensor box 102 may be constructed such that its shape and dimensions match those of a combustor observation port 900 (FIG. 9*a*) so that it may be attached to such a port. As shown in FIGS. 9*a* and 9*b*, box 102 may include several internal plates 902*a*–902*c* that may divide box 102 into several distinct chambers 904*a*–904*d*. Each of chambers 904*a*–904*d* may form a channel between an end 906 that may be connected to a combustor wall 910 and a distal end 908 that is located opposite to end 906. End 906 may be mounted to combustor wall 910 such that chambers 904*a*–904*d* are open to the combustor, and end 908 may be covered by a lightweight flap 912. Flap 912 may, for example, be pivotally connected to an upper edge of box 102 such that it can be easily opened by positive pressure in the boiler.

Each of plates 902*a*–*c* may have a respective opening 914*a*–*c* in it. A top surface of box 102 also may have an opening 914*d* in it. As shown, openings 914*a*–914*d* may be positioned in a line of sight 922 of a sensor 920 mounted in a pipe 104 affixed to and enclosing opening 914*d* such that sensor 920 can "see" directly into the combustor to the appropriate zone (i.e., the flame-envelope or the post-flame zone, depending on the sensor's use). Sensor 920 can be mounted in pipe 104 such that it can be quickly and easily replaced.

In case of an occasional pressure increase in the boiler, the gas streams (a, b, c) between plates 902*a*–902*c* may force rear flap 912 to open and relieve gas into the atmosphere. Each of these gas streams (a, b, c), cross the stream "x," which is directed through opening 914 toward sensor 920, and divert a large part of the stream "x" through chambers 904*a*–904*d* towards flap 912. As a result, most of the stream "x" is diverted from the sensor, its energy is dissipated, and the sensor 920 remains protected, even during very significant pressure spikes in the boiler.

Sensor box 102 therefore can make the operation of optical sensor 920 virtually maintenance-free even in a harsh boiler environment.

Having thus described at least one illustrative embodiment of the invention, various alterations, modifications and improvements will readily occur to those skilled in the art. Such alterations, modifications and improvements are intended to be within the spirit and scope of the invention. Accordingly, the foregoing description is by way of example only and is not intended as limiting. The invention is limited only as defined in the following claims and the equivalents thereto.

What is claimed is:

1. A method for analyzing operation of a combustor comprising the steps of:

(a) monitoring radiation emitted from flue gas in a post-flame zone of the combustor; and (b) analyzing an AC component of the monitored radiation to determine at least one combustion parameter based thereupon.

2. The method as claimed in claim 1, wherein:

step (a) includes the step of monitoring radiation emitted from flue gas in a plurality of locations in the post-flame zone of the combustor;

step (b) includes the step of determining a plurality of combustion parameters, each combustion parameter being determined based upon an AC component of the radiation emitted from the flue gas in one of the plurality of locations; and and further comprising the step of:

(c) adjusting at least one operating parameter of at least one combustion device until the plurality of combustion parameters achieve a predetermined profile.

3. The method as claimed in claim 1, wherein step (b) includes the steps of:

(b1) generating a function having a shape that changes in response to changes in the AC component of the monitored radiation; and (b2) analyzing at least one characteristic of the function to determine the at least one combustion parameter.

4. The method as claimed in claim 3, wherein:

step (a) includes the step of producing a signal indicative of the monitored radiation; and step (b1) includes the steps of:

converting the signal into a frequency-domain amplitude spectrum, and generating the function in response to a content of the frequency-domain amplitude spectrum.

5. The method as claimed in claim 4, further comprising the step of:

(c) correlating the at least one combustion parameter with at least one combustion variable.

6. The method as claimed in claim 5, wherein step (c) includes the step of correlating the at least one combustion parameter with an amount of unburned carbon in fly ash.

7. The method as claimed in claim 1, wherein:

step (a) includes the step of producing a signal indicative of the monitored radiation; and step (b) includes the steps of:

(b1) converting the signal into a frequency-domain amplitude spectrum, and (b2) determining at least one combustion parameter based upon at least one characteristic of the frequency-domain amplitude spectrum.

8. The method as claimed in claim 1, wherein step (b) includes the step of analyzing at least one characteristic of a time-domain signal produced in response to the monitored radiation.

9. The method as claimed in claim 1, further comprising the step of:

(c) correlating the at least one combustion parameter with at least one combustion variable.

10. The method as claimed in claim 9, wherein step (c) includes the step of correlating the at least one combustion parameter with an amount of unburned carbon in fly ash.

11. A method for analyzing operation of a combustor comprising the steps of:

(a) monitoring radiation emitted from flue gas in a post-flame zone of the combustor;

(b) analyzing an AC component of the monitored radiation according to a first algorithm;

(c) analyzing the AC component of the monitored radiation according to a second algorithm; and (d) combining results of the first and second algorithms to determine at least one combined combustion parameter.

12. The method as claimed in claim 11, wherein:

step (b) includes the step of determining at least one first combustion parameter based upon the AC component of the monitored radiation;

step (c) includes the step of determining at least one second combustion parameter based upon the AC component of the monitored radiation; and step (d) includes the step of combining the first and second combustion parameters to determine the at least one combined combustion parameter.

13. The method as claimed in claim 12, wherein step (d) includes the step of multiplying the first and second combustion parameters to determine the at least one combined combustion parameter.

14. The method as claimed in claim 11, wherein:

step (b) includes the step of analyzing at least one characteristic of a time-domain signal produced in response to the monitored radiation; and step (c) includes the step of analyzing at least one characteristic of a function generated in response to a frequency-domain representation of the monitored radiation.

15. The method as claimed in claim 11, further comprising the step of:

(e) correlating the at least one combined combustion parameter with at least one combustion variable.

16. The method as claimed in claim 15, wherein step (e) includes the step of correlating the at least one combined combustion parameter with an amount of unburned carbon in fly ash.

17. A method for analyzing operation of a combustor comprising the steps of:

(a) monitoring radiation emitted within the combustor;

(b) producing a time-domain signal representing a measured amplitude of the monitored radiation;

(c) determining an average amplitude of the signal during a particular time period;

(d) counting at least one of:

a number of high peaks in the signal that, during the particular time period, achieve an amplitude, relative to the average amplitude, that is greater than a first threshold, and a number of low peaks in the signal that, during the particular time period, achieve an amplitude, relative to the average amplitude, that is less than a second threshold; and (e) using the at least one of the number of high peaks and the number of low peaks counted in step (d) to determine at least one combustion parameter.

18. The method as claimed in claim 17, further comprising the step of:

(f) correlating the at least one combustion parameter with at least one combustion variable.

19. The method as claimed in claim 18, wherein step (f) includes the step of correlating the at least one combustion parameter with an amount of unburned carbon in fly ash.

20. The method as claimed in claim 18, wherein step (f) includes the step of correlating the at least one combustion parameter with an amount of Nitrogen Oxides (NOx).

21. The method as claimed in claim 17, wherein step (a) includes the step of monitoring radiation emitted from flue gas in a post-flame zone of the combustor.

22. The method as claimed in claim 17, wherein step (a) includes the step of monitoring radiation emitted from a flame zone of the combustor.

23. A method for monitoring an amount of unburned carbon in fly ash comprising the steps of:

(a) monitoring radiation emitted from flue gas in a post-flame zone of a combustor; and (b) analyzing the monitored radiation to determine the amount of unburned carbon in fly ash.

24. The method as claimed in claim 23, wherein step (b) includes the step of:

determining the amount of unburned carbon in fly ash based upon an AC component of the monitored radiation.

25. A method for analyzing operation of a combustor comprising the steps of:

(a) using a first radiation sensor, that is sensitive to a first portion of an electromagnetic spectrum, to monitor radiation emitted from flue gas in a post-flame zone of the combustor;

(b) using a second radiation sensor, that is sensitive to a second portion of the electromagnetic spectrum which is different from the first portion, to monitor radiation emitted from flue gas in the post-flame zone of the combustor; and (c) analyzing outputs of each of the first and second radiation sensors to determine at least one combined combustion parameter.

26. The method as claimed in claim 25, wherein:

step (c) includes the steps of:

(c1) analyzing the output of the first radiation sensor to determine at least one first combustion parameter;

(c2) analyzing the output of the second radiation sensor to determine at least one second combustion parameter; and (c3) combining the first and second combustion parameters to determine the at least one combined combustion parameter.

27. The method as claimed in claim 26 wherein step (c3) includes the step of multiplying the first and second combustion parameters to determine the at least one combined combustion parameter.

28. The method as claimed in claim 25, further comprising the step of:

(d) correlating the at least one combustion parameter with at least one combustion variable.

29. The method as claimed in claim 28, wherein step (d) includes the step of correlating the at least one combustion parameter with an amount of unburned carbon in fly ash.

30. A system for analyzing operation of a combustor comprising:

at least one radiation sensor arranged to monitor radiation emitted from flue gas in a post-flame zone of the combustor and to produce a signal indicative thereof; and analyzing means for determining at least one combustion parameter based upon an AC component of the signal.

31. The system as claimed in claim 30, wherein the analyzing means includes:

means for processing the signal to generate a function having a shape that changes in response to changes in the AC component of the signal; and means for analyzing at least one characteristic of the function to determine the at least one combustion parameter.

32. The system as claimed in claim 31, wherein the means for processing includes:

means for converting the signal into a frequency-domain amplitude spectrum, and means for generating the function in response to a content of the frequency-domain amplitude spectrum.

33. The system as claimed in claim 30, wherein the analyzing means includes:

means for conventing the signal into a frequency-domain amplitude spectrum, and means for determining the at least one combustion parameter based upon at least one characteristic of the frequency-domain amplitude spectrum.

34. The system as claimed in claim 30, wherein the analyzing means includes means for analyzing at least one characteristic of the signal in the time domain.

35. A system for analyzing operation of a combustor comprising:

at least one radiation sensor to monitor radiation emitted from flue gas in a post-flame zone of the combustor and to produce a signal indicative thereof;

first means for analyzing an AC component of the signal according to a first algorithm;

second means for analyzing the AC component of the signal according to a second algorithm; and means for combining results of the first and second algorithms to determine at least one combined combustion parameter.

36. The as claimed in claim 35, wherein:

the first means for analyzing includes means for determining at least one first combustion parameter based upon the AC component of the signal;

the second means for analyzing includes means for determining at least one second combustion parameter based upon the AC component of the signal; and the means for combining includes means for combining the first and second combustion parameters to determine the at least one combined combustion parameter.

37. The system as claimed in claim 35, wherein:

the first means for analyzing includes means for determining at least one characteristic of the signal in the time-domain; and the second means for analyzing includes means for determining at least one characteristic of a function generated in response to a frequency-domain representation of the signal.

38. A system for analyzing operation of a combustor comprising:

at least one radiation sensor to monitor radiation emitted within the combustor and to produce a signal indicative thereof;

means for determining an average amplitude of the signal during a particular time period;

means for counting at least one of:

a number of high peaks in the signal that, during the particular time period, achieve an amplitude, relative to the average amplitude, that is greater than a first threshold, and a number of low peaks in the signal that, during the particular time period, achieve an amplitude, relative to the average amplitude, that is less than a second threshold; and means for using the at least one of the number of high peaks and the number of low peaks counted by the means for counting to determine at least one combustion parameter.

39. The system as claimed in claim 38, wherein the at least one radiation sensor is arranged to monitor radiation emitted from flue gas in a post-flame zone of the combustor.

40. The system as claimed in claim 38, wherein the at least one radiation sensor is arranged to monitor radiation emitted from a flame zone of the combustor.

41. A system for continuous, on-line monitoring of an amount of unburned carbon in fly ash generated by a combustor comprising:

at least one radiation sensor to monitor radiation emitted from flue gas in a post-flame zone of the combustor and to produce a signal indicative thereof; and means for analyzing the signal to monitor the amount of unburned carbon in fly ash generated by the combustor.

42. The system as claimed in claim 41, wherein the means for analyzing includes means for determining the amount of unburned carbon in fly ash based upon an AC component of the monitored radiation.

43. A system for analyzing operation of a combustor comprising:

at least one first radiation sensor, that is sensitive to a first portion of an electromagnetic spectrum, to monitor radiation emitted from flue gas in a post-flame zone of the combustor;

at least one second radiation sensor, that is sensitive to a second portion of the electromagnetic spectrum which is different from the first portion, to monitor radiation emitted from flue gas in the post-flame zone of the combustor; and analyzing means for determining at least one combined combustion parameter based upon outputs of each of the first and second radiation sensors.

44. The system as claimed in claim 43, wherein the analyzing means includes:

means for determining at least one first combustion parameter based upon the output of the at least one first radiation sensor;

means for determining at least one second combustion parameter based upon the output of the at least one second radiation sensor; and means for combining the first and second combustion parameters to determine the at least one combined combustion parameter.

45. A computer-readable medium for use with a processor operatively coupled to at least one radiation sensor, the medium having a plurality of instructions stored thereon which, when executed by the processor, cause the processor to perform the steps of:

(a) calculating an average amplitude of a signal generated by the at least one radiation sensor during a particular time period;

(b) counting at least one of:

a number of high peaks in the signal that, during the particular time period, achieve an amplitude, relative to the average amplitude, that is greater than a first threshold, and a number of low peaks in the signal that, during the particular time period, achieve an amplitude, relative to the average amplitude, that is less than a second threshold; and (c) using the at least one of the number of high peaks and the number of low peaks counted in step (b) to determine at least one combustion parameter.

46. A computer-readable medium for use with a processor operatively coupled to at least one radiation sensor monitoring radiation emitted from flue gas in a post-flame zone of a combustor, the medium having a plurality of instructions stored thereon which, when executed by the processor, cause the processor to perform the step of:

(a) analyzing an output of the at least one radiation sensor to determine an amount of unburned carbon in fly ash.

* * * * *

UNITED STATES PATENT AND TRADEMARK OFFICE

CERTIFICATE OF CORRECTION

PATENT NO. : 6,389,330 B1
DATED : May 14, 2002
INVENTOR(S) : Mark J. Khesin

It is certified that error appears in the above-identified patent and that said Letters Patent is hereby corrected as shown below:

Column 4,
Line 55, please replace “;” with -- : --.

Column 11,
Line 7, please replace “At” with -- Δt --
Line 55, please replace “$N_{i-}$” with -- $N_{i+}$ --

Signed and Sealed this

Eleventh Day of February, 2003

JAMES E. ROGAN
*Director of the United States Patent and Trademark Office*